US006669330B2

(12) United States Patent
Vanhooydonck et al.

(10) Patent No.: US 6,669,330 B2
(45) Date of Patent: Dec. 30, 2003

(54) STAGGERED MULTI-PHASE FIRING OF NOZZLE HEADS FOR A PRINTER

(75) Inventors: Rudi Vanhooydonck, Zwijndrecht (BE); Patrick Van den Bergen, Hove (BE)

(73) Assignee: AGFA-Gevaert, Mortsel (BE)

( * ) Notice: Subject to any disclaimer, the term of this patent is extended or adjusted under 35 U.S.C. 154(b) by 0 days.

(21) Appl. No.: 10/410,971

(22) Filed: Apr. 10, 2003

(65) Prior Publication Data

US 2003/0210297 A1 Nov. 13, 2003

Related U.S. Application Data

(60) Provisional application No. 60/382,329, filed on May 22, 2002.

(30) Foreign Application Priority Data

May 8, 2002 (EP) ..... 02100467

(51) Int. Cl.[7] ..... B41J 2/145; B41J 2/15

(52) U.S. Cl. ..... 347/41

(58) Field of Search ..... 347/41, 40, 9, 347/10, 14, 19

(56) References Cited

U.S. PATENT DOCUMENTS 4,812,859 A * 3/1989 Chan et al. ..... 347/43
4,972,270 A 11/1990 Kurtin et al. ..... 358/296
6,367,908 B1 * 4/2002 Serra et al. ..... 347/37

FOREIGN PATENT DOCUMENTS

EP 0 623 473 A2 11/1994
EP 02 10 0467 10/2002

* cited by examiner

*Primary Examiner*—Thinh Nguyen
(74) *Attorney, Agent, or Firm*—John A. Merecki; Hoffman, Warnick & D'Alessandro

(57) ABSTRACT

The present invention describes a method for printing, with one type of printhead, with a resolution that differs from the resolution of the type of printhead used. In the method according to the present invention, the speed in the fast scan direction is changed with reference to a reference velocity which the printhead is intended to be driven with, while preferably keeping the firing frequency of the sets of nozzles unchanged. The firing order of the may or may not be changed.

10 Claims, 6 Drawing Sheets

STAGGERED MULTI-PHASE FIRING OF NOZZLE HEADS FOR A PRINTER

The application claims the benefit of U.S. Provisional Application No. 60/382329 filed May 22 2002.

FIELD OF THE INVENTION

The present invention relates to apparatus and methods for printing and in particular to drop-on-demand (DOD) inkjet printing methods and apparatus.

BACKGROUND OF THE INVENTION

When DOD inkjet is considered, two main groups can be discerned: thermal inkjet and piezo inkjet.

With thermal inkjet technology, tiny resistors rapidly heat a thin layer of liquid ink. The heated ink causes a vapour bubble to be formed, expelling or ejecting drops of ink through nozzles and placing them precisely on a surface to form text or images. As the bubble collapses, it creates a vacuum that pulls in fresh ink. This process is repeated thousands of times per second. With thermal inkjet technology, water-based inks are used.

Piezoelectric printing technology—commonly called piezo—pumps ink through nozzles using pressure, like a squirt gun. A piezo crystal used as a very precise pump places ink onto the printing medium. A wide range of ink formulations (solvent, water, UV) may be used.

A number of different piezo concepts exist.

A typical concept, as described in U.S. Pat. No. 4,887,100, WO 96/10488, WO 97/04963 and WO 99/12738, uses so called shared walls. The pressure chambers containing the ink are next to each other, while their dividing walls are the actuators.

Because an actuator is always shared by two channels, it is not possible to jet a drop out of two neighbouring channels at the same time. In WO 96/10488 is described that the nozzles are divided in three interlaced groups (A, B, C). Neighbouring nozzles are fired in a sequence ABC. Two solutions are possible to print dots on a straight line.

A first solution uses a complete nozzle array under a certain angle. By doing this, the resolution is increased, and by using the right fast scan speed, dots fired in a sequence A, B, C are on a straight line.

A second solution uses a head perpendicular to the fast scan direction, in which the A, B, and C nozzles are staggered in the fast scan direction. Printing of a line of pixels is divided into three cycles. In the first cycle, the dividing walls to either side of the A channels are driven (if ink is to be ejected from them—depending on the image to be printed) with a pulsed signal. In the second cycle, the dividing walls to either side of the B channels are driven (if ink is to be ejected from them—depending on the image to be printed) with a pulsed signal. In the third cycle, the dividing walls to either side of the C channels are driven (if ink is to be ejected from them—depending on the image to be printed) with a pulsed signal. The pressure pulses developed in the channels that are not included in the current cycle are not larger than ½ of those in the channels that are intended to eject ink. The printing apparatus is arranged so that such pulses with ½ magnitude do not cause ink ejection.

A drawback of this concept is that, once the firing frequency is defined, only one fast scan speed can be used to print ABC dots on a straight line, as explained hereinafter. In the fast scan direction, the head will e.g. print each 1/360-inch.

FIG. 1 shows a piezo printhead 10 according to the prior art, having nozzles 12 which are divided into three sets, called a set of A nozzles, a set of B nozzles and a set of C nozzles, each set intended to be fired during different firing cycles. The different sets of nozzles are staggered with respect to each other over a stagger distance D1 in the fast scan direction. If the nozzles are divided in groups G of three, every first nozzle is part of the set of A nozzles, every second nozzle is part of the set of B nozzles and every third nozzle is part of the set of C nozzles. All nozzles in one set A, B, C are positioned on a straight line in the slow scan direction S, which lines are located at the stagger distance D1 with respect to each other in the fast scan direction F.

As an example, printhead 10 is considered to be a type 360 head. This means that the printhead 10 is provided for printing 360 dpi (=pixels per inch) in the fast scan direction F. In this type 360 printhead 10, the distance D1 between nozzles 12 in the fast scan direction F is 1/360 inch/3=70.56 $\mu$m 3=23.52 $\mu$m.

If the firing frequency is 12.4 kHz, meaning that every set A, B, C of nozzles can be fired every 80.65 $\mu$, the speed of the printhead 10 in the fast scan direction F is 1/360 inch*12.4 kHz=0.875 m/s. The nozzles 12 are fired in an ABC sequence, with the A nozzles at the leading edge of the printhead 10 in the fast scan direction F.

The cycle frequency is 12.4 kHz*3=37.2 kHz. Or formulated in another way: the set of B nozzles fires 26.88 $\mu$s after the set of A nozzles, and the set of C nozzles fires 53.76 $\mu$s after the set of A nozzles. After 80.65 $\mu$s, the set of A nozzles fires again.

One type of printing may be called "mutually interstitial printing", also called shingling e.g. as in U.S. Pat. No. 4,967,203, in which adjacent pixels on a raster line in the fast scan direction are not printed by the same nozzle in the printhead. Printing dictionaries, however, refer to "shingling" as a method to compensate for creep in bookmaking. The inventors are not aware of any industrially accepted term for the printing method wherein no adjacent pixels on a raster line are printed by one and the same nozzle. Therefore, from here on and in what follows, the terms "mutually interstitial printing" or "interstitial mutually interspersed printing" are used. It is meant by these terms that an image to be printed is split up in a set of sub-images, each sub-image comprising printed parts and spaces, and wherein at least a part of the spaces in one printed sub-image form a location for the printed parts of another sub-image, and vice versa.

When it would be desired to keep the same firing frequency, but to print a 180*180 dpi image with the 360 type printhead of the example given above, the printhead speed should theoretically double to 1.750 m/s. In the above case of printing a 180*180 dpi image with a 360 type printhead, where the printhead speed must double to 1.750 m/s, the delays for firing B and C need to be shorter to make sure that dots are printed on the same line. Nozzle set B has to be fired 13.44 $\mu$s after nozzle set A, and nozzle set C 26.88 $\mu$s after nozzle set A. These firing frequencies are too close one to the other, and therefore a 360 type printhead cannot be used to print a 180*180 dpi image.

When it would be desired, on the other hand, to print a 720*720 dpi image with the 360 type printhead, the firing delay between the set of A nozzles, set of B nozzles and set of C nozzles increases to 53.76 $\mu$. As, however, after 80.65 $\mu$the set of A nozzles has to fire again, there is not enough time left to fire the set of C nozzles, and therefore a 360 type printhead cannot be used to print a 720*720 dpi image neither.

It is an object of the present invention to provide a method for printing, with one type of printhead, with a resolution which differs from the design resolution of the type of printhead used.

SUMMARY OF THE INVENTION

The above objective is accomplished by a method of driving a print head according to the present invention. A print head used has a longitudinal axis in a slow scan direction and has an array of marking elements comprising at least one group of marking elements. Marking elements of one group are staggered with respect to each other over a stagger distance in a fast scan direction, which is perpendicular to the slow scan direction. The print head is intended to be driven with a reference velocity Vref, which is equal to the stagger distance, multiplied by a reference firing frequency Fref. One marking element of a group is able to be fired at each reference firing frequency pulse (whether it fires depends upon the image to be printed). The marking elements of the print head are intended to be fired according to a reference firing order to print an image with a first resolution. The method of the present invention is characterised in that it is operated at an operating velocity that is different from the reference velocity so as to print the same image with a different resolution.

If there are n marking elements in one group, wherein the operating velocity may be equal to $$\frac{\text{reference velocity}}{nX+1}$$

or to $$\frac{\text{reference velocity}}{nX-1},$$

X being an integer larger than 0. In the first case. In the first case, the firing order of the marking elements equals the reference firing order, in the second case it equals the inverse of the reference firing order.

The above methods may be used for carrying out fast mutually interstitial printing.

The present invention also includes a printing device with a print head (10) having a longitudinal axis in a first direction (S) and having an array of marking elements (A, B, C; A, B, C, D) comprising at least one group (G) of marking elements (A, B, C; A, B, C, D), marking elements (A, B, C; A, B, C, D) of one group (G) being staggered with respect to each other over a stagger distance (D1) in a second direction (F) perpendicular to the first direction (S), the print head (10) being intended to be driven with a reference velocity (Vref) equal to the stagger distance (D1) multiplied by a reference firing frequency (Fref), one marking element of a group being firable at each reference firing frequency pulse, the marking elements (A, B, C; A, B, C, D) of the print head (10) being intended to be fired according to a reference firing order to print an image at a first resolution, further comprising means for driving the print head (10) at an operating velocity which is different from the reference velocity to print the same image at a second resolution of printing. For this printing device there may be n marking elements (A, B, C; A, B, C, D) in one group (G) and the operating velocity for printing with the second resolution is equal to $$\frac{\text{reference velocity}}{nX+1},$$

X being an integer larger than or equal to 0., the firing order of the marking elements (A, B, C; A, B, C, D) to print the second resolution being the same as the reference firing order (ABC; ABCD). Alternatively, this printing device has n marking elements (A, B, C; A, B, C, D) in one group (G), wherein the operating velocity to print the second resolution is equal to $$\frac{\text{reference velocity}}{nX-1},$$

X being an integer larger than 0, the firing order of the marking elements (A, B, C; A, B, C, D) to print the second resolution equalling the inverse of the reference firing order (CBA; DCBA).

For either of these arrangements the marking elements (A, B, C; A, B, C, D) of one group (G) may be staggered with respect to each other over a stagger distance (D1) in a second direction (F) perpendicular to the first direction (S) to form a plurality of rows of marking elements, and the printing device may be adapted to supply printing data representing the image to the marking elements of one row which is delayed with respect to the printing data supplied to another row.

The present invention also includes a computer program product for executing any of the methods of the present invention when executed on a computing device associated with a printing head. A machine readable data storage device may store the computer program product. The computer program product may be transmitted over a local or wide area telecommunications network.

The present invention also includes a control unit for a printer for printing an image on a printing medium using a print head (10) having a longitudinal axis in a first direction (S) and having an array of marking elements (A, B, C; A, B, C, D) comprising at least one group (G) of marking elements (A, B, C; A, B, C, D), marking elements (A, B, C; A, B, C, D) of one group (G) being staggered with respect to each other over a stagger distance (D1) in a second direction (F) perpendicular to the first direction (S), the control unit being adapted to control the driving of the print head (10) with a reference velocity (Vref) equal to the stagger distance (D1) multiplied by a reference firing frequency (Fref), and for controlling the firing of one marking element of a group at each reference firing frequency pulse, and for controlling the firing of the marking elements (A, B, C; A, B, C, D) of the print head (10) according to a reference firing order to print the image at a first resolution, further comprising means for controlling the driving of the print head (10) at an operating velocity which is different from the reference velocity to print the image at a second resolution of printing.

Although there has been constant improvement, change and evolution of devices in this field, the present concepts are believed to represent substantial new and novel improvements, including departures from prior practices, resulting in the provision of more efficient devices of this nature.

Other features and advantages of the present invention will become apparent from the following detailed description, taken in conjunction with the accompanying drawings, which illustrate, by way of example, the principles of the invention. This detailed description is given for the sake of example only, without limiting the scope of the invention. The reference figures quoted below refer to the attached drawings.

DETAILED DESCRIPTION OF THE INVENTION

Figure 1:
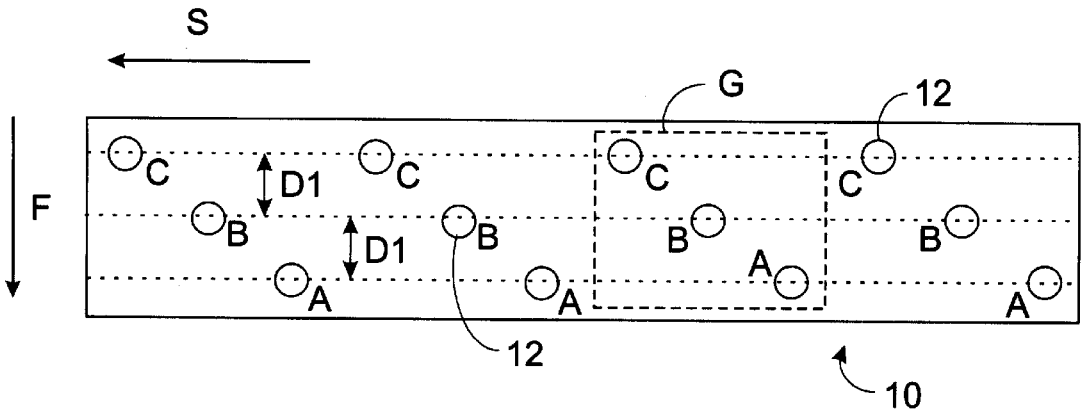
FIG. 1 is a front view of a printhead with staggered marking elements as known in the prior art.

The present invention will be described with reference to various embodiments and drawings but the present invention is not limited thereto but only by the claims.

The term "printing" as used in this invention should be construed broadly. It relates to forming markings whether by ink or other materials or methods onto a printing substrate. Various printing methods which may be used with the present invention are described in the book "Principles of non-impact printing", J. L. Johnson, Palatino Press, Irvine, 1998, e.g. thermal transfer printing, thermal dye transfer printing, deflected ink jet printing, ion projection printing, field control printing, impulse ink jet printing, drop-on-demand ink jet printing, continuous ink jet printing. Non-contact printing methods are particularly preferred. However, the present invention is not limited thereto. Any form of printing including dots or droplets on a substrate is included within the scope of the present invention, e.g. piezoelectric printing heads may be used to print polymer materials as used and described by Plastic Logic (http://plasticlogic.com/) for the printing of thin film transistors. Hence, the term "printing" in accordance with the present invention not only includes marking with conventional staining inks but also the formation of printed 2-D or 3-D structures or areas of different characteristics on a substrate. On example is the printing of water repellent or water attractive regions on a substrate in order to form an off-set printing plate by printing. Accordingly, the term "printing medium" or "printing substrate" should also be given a wide meaning including not only paper, transparent sheets, textiles but also flat plates or curved plates which may be included in or be part of a printing press. In addition the printing may be carried out at room temperature or at elevated temperature, e.g. to print a hot-melt adhesive the printing head may be heated above the melting temperature. Accordingly, the term "ink" should also be interpreted broadly including not only conventional inks but also solid materials such as polymers which may be printed in solution or by lowering their viscosity at high temperatures as well as materials which provide some characteristic to a printed substrate such as information defined by a structure on the surface of the printing substrate, water repellence, or binding molecules such as DNA which are spotted onto microarrays. As solvents both water and organic solvents may be used. Inks as used with the present invention may include a variety of additives such as ant-oxidants, pigments and cross-linking agents.

In the following the invention will be described with respect to one type of printing, e.g. ink jet printing in which a printhead traverses with respect to a printing medium in a first direction (fast scan direction) while the print medium indexes forwards relative to the printhead in a direction perpendicular to this (slow scan direction). In a method according to the present invention, the speed in the fast scan direction is changed with reference to a reference velocity which the printhead is intended to be driven with, while preferably keeping the firing frequency of the sets of nozzles unchanged. This is done in order to be able to print, with a printhead of a certain type, which is intended to print images with a certain resolution, images with other resolutions. If needed, the firing sequence is changed as well.

FIRST EMBODIMENT: THREE MARKING ELEMENTS IN A GROUP

A printhead 10 used according to the first embodiment has three sets of marking elements or nozzles 12: a set of A-nozzles, a set of B-nozzles and a set of C-nozzles. This means that there a three nozzles 12 in one group G, as represented in FIG. 1.

For a printhead 10 intended to print images of a certain basic resolution, changing the firing sequence from ABC to CBA while using half the fast scan speed used for the ABC sequence, makes it possible to print images with a resolution which is the double of the basic resolution. For example a type 360 head, with a stagger distance D1 of 23.52 $\mu$m between two neighbouring sets of nozzles, which head 10 is normally intended to be fired (in an ABC firing sequence) at a frequency of 12.4 kHz and moved with a speed of 0.875 m/s, can be used for printing images with a resolution of 720 dpi by using half the fast scan speed (i.e. 0.4375 m/s) and by firing the nozzles in a sequence CBA.

If the example of the above type 360 head is worked out further, the following is obtained. If the set of C nozzles is fired first, the set of B nozzles is already 23.52 $\mu$m ahead in the fast scan direction F. At a speed of 0.875 m/s (at a firing frequency of 10 12.4 kHz), the set of B nozzles would have travelled another 23.52 $\mu$m in the fast scan direction F before actually firing. When, however, half the fast scan speed is used, the set of B nozzles will only travel over 11.76 $\mu$m before it is fired, so that there is a distance of 35.28 $\mu$m in the fast scan direction between the dots is printed by the set of C nozzles and the dots printed by the set of B nozzles. This corresponds to the distance between dots in a 720 dpi image.

With the CBA firing sequence, the dots printed by the sets of A, B and C nozzles in one cycle are not printed on one straight line, with a pitch of 1/360 inch between lines printed during different cycles, but instead they are printed on three different lines with a pitch of 1/720 inch between them.

Also other pitches or modes are possible with the same head type at different fast scan speeds. The only difference with the "standard pitch" is that the dots printed during one CBA cycle are not on one straight line, contrary to the dots printed during one normal ABC cycle. With a "normal ABC cycle" is meant: firing the nozzles 12 in an ABC firing sequence, with a reference firing frequency and driving the head 10 with a reference driving speed for which the head 10 is intended.

In general, the following relationship between the speeds is obtained:

$$v_{mode} = \frac{v_{FF}}{c} \tag{1}$$

with $v_{mode}$ the speed for the considered mode $v_{FF}$ the reference speed for the head type for use with a predetermined firing frequency FF. The speed $V_{FF}$ is given by (phi) ϕ×nozzle stagger distance ($D_I$)×the firing frequency where ϕ (phi) is the number of staggered rows of nozzles.

$$\text{mode}=c^*\text{headtype expressed in dpi,} \tag{2}$$

where, $$\text{in case } c=3\,i+1, \text{ with } i=\text{integer}\leqq 0 \tag{3}$$

the firing sequence is ABC $$\text{in case } c=3i=1, \text{ with i=integer}>0 \tag{4}$$

the firing sequence is CBA

This means that, for the present embodiment it is impossible to print in a mode that has a speed $v_{mode}$, which e.g. equals one third of the reference speed $v_{FF}$ for the head type (as c is either 3i+1 or 3i−1 and can never be a factor of 3). This also means that, for this embodiment, it is impossible to print images with a resolution that equals a plurality of three times the resolution of the head used.

A more in depth analysis shows that a type 90 head offers following possibilities:

TABLE 1

| Head type | Nozzle stagger | Firing frequency | Desired image resolution in fast scan direction | Head speed | Cycling direction |
|---|---|---|---|---|---|
| 90 | 94.07 μm | 12400 Hz | 90 dpi | 3.50 m/s | ABC |
| 90 | 94.07 μm | 12400 Hz | 180 dpi | 1.75 m/s | CBA |
| 90 | 94.07 μm | 12400 Hz | 360 dpi | 0.87 m/s | ABC |
| 90 | 94.07 μm | 12400 Hz | 450 dpi | 0.70 m/s | CBA |
| 90 | 94.07 μm | 12400 Hz | 630 dpi | 0.50 m/s | ABC |
| 90 | 94.07 μm | 12400 Hz | 720 dpi | 0.44 m/s | CBA |
| 90 | 94.07 μm | 12400 Hz | 900 dpi | 0.35 m/s | ABC |
| 90 | 94.07 μm | 12400 Hz | 990 dpi | 0.32 m/s | CBA |
| 90 | 94.07 μm | 12400 Hz | 1170 dpi | 0.27 m/s | ABC |
| 90 | 94.07 μm | 12400 Hz | 1260 dpi | 0.25 m/s | CBA |
| 90 | 94.07 μm | 12400 Hz | 1440 dpi | 0.22 m/s | ABC |

As mentioned above, the pixels printed during one printing cycle are not printed in one row. The distance between the pixels printed by a B- or C-nozzle and an A-nozzle during the same cycle is given by (expressed in 1/mode pitch):

$$\text{pitch} = \frac{1}{mode} = \frac{1}{c * headtype}\text{[inches]} \tag{5}$$

For ABC-cycling:

$$\Delta cycle_{A-B} = \text{int}\left(\frac{c}{3}\right) = \frac{c - cmod3}{3} \text{ or} \tag{6}$$

-continued $$distance_{A-B} = (\Delta cycle_{A-B} * \text{pitch})\text{[inches]}$$

$$\Delta cycle_{A-C} = \text{int}\left(\frac{2c}{3}\right) = \frac{2c - 2cmod3}{3} \text{ or}$$

$$distance_{A-C} = (\Delta cycle_{A-C} * \text{pitch})\text{[inches]}$$

According to the above, if nozzle A prints dots on an image line during cycle x, the B nozzles will print during cycle x+int(c/3) and the C nozzles during cycle x+int(2c/3) on the same image line.

Thus for a type 90 head printing in 360 mode, c=4 and $\Delta cycle_{A-B}=1$ and $\Delta cycle_{A-C}=2$, so if nozzles A print dots on an image line during cycle x, nozzles B print dots on that image line during cycle x+1 and nozzles C print dots on that image line during cycle x+2.

For CBA-cycling:

$$\Delta cycle_{B-A} = \text{int}\left(\frac{c}{3}\right) + 1 \text{ or} \tag{7}$$

$$distance_{B-A} = (\Delta cycle_{B-A} * \text{pitch})\text{[inches]}$$

$$\Delta cycle_{A-C} = \text{int}\left(\frac{2c}{3}\right) + 1 \text{ or}$$

$$distance_{C-A} = (\Delta cycle_{C-A} * \text{pitch})\text{[inches]}$$

According to the above, if nozzle A prints dots on an image line during cycle x, the B nozzles will print on the same image line during cycle x+int(c/3)+1 and the C nozzles will print on the same image line during cycle x+int(2c/3)+1.

Thus for a type 360 head printing in 720 mode, c=2 and $\Delta cycle_{B-A}=1$ and $\Delta cycle_{C-A}=2$, so if nozzles A print dots on an image line during cycle x, nozzles B print dots on that image line during cycle x+1 and nozzles C print dots on that image line during cycle x+2.

Figure 2:
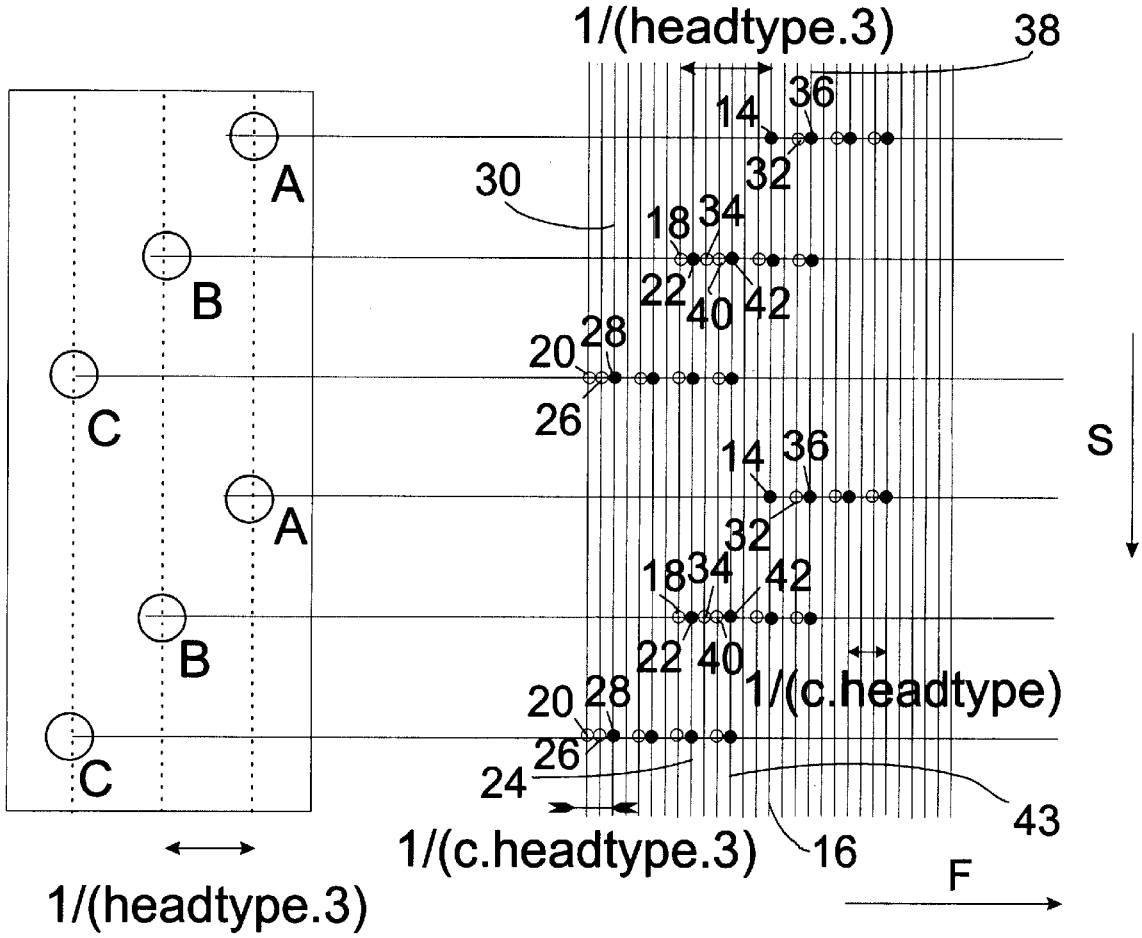
FIG. 2 schematically illustrates an ABC printing scheme of a printhead according to FIG. 1.

FIG. 2 shows an ABC firing case at c=7, e.g. a type 90 head in 630 dpi mode. As shown in table 1, the normal speed or reference speed for a 90 type head is 3.50 m/s. According to equation (1), the speed in the 630 dpi mode is 3.50/7=0.50 m/s, as also shown in Table 1. Equation (3) shows that for c=7, the nozzles are to be driven in an ABC sequence.

During a first cycle, the set of A nozzles is driven first. Where necessary (according to the image) A nozzles eject a drop on locations 14 on a straight line 16 in the slow scan direction S. At the moment of firing the set of A nozzles, the set of B nozzles is located at a location 18 at a distance of 1/(headtype.3)=1/90.3=1/270 inches=94.07 μm behind the set of A nozzles, and the set of C nozzles is located at a location 20 at a distance of 188.15 μm behind the set of A nozzles. Before firing the set of B nozzles, the head 10 is moved over a distance 1/(c.headtype.3)=1/1890 inches=13.44 μm in the fast scan direction F. During the first cycle, the set of B nozzles ejects a drop on locations 22 on a straight line 24 in the slow scan direction S, where necessary according to the image to be printed. At the moment of firing the set of B nozzles, the set of C nozzles is located at a location 26 at a distance of 94.07 μm behind the set of B nozzles. Before firing the set of C nozzles, the head 10 is moved over a distance 1/(c.headtype.3)=1/1890 inches=13.44 μm in the fast scan direction F. During the first cycle, the set of C nozzles ejects a drop on locations 28 on a straight line 30 in the slow scan direction S, where necessary according to the image to be printed.

At the moment of firing the set of C nozzles, the set of A nozzles is located at a location 32 at a distance of 188.15 μm in front of the set of C nozzles, and the set of B nozzles is located at a location 34 at a distance of 94.07 μm behind the set of A (or 94.07 μm in front of the set of C nozzles). Before firing the set of A nozzles during a second cycle, the head 10 is moved over a distance of 13.44 μm in the fast scan direction F. During the second cycle, the set of A nozzles eject a drop on locations 36 on a straight line 38 in the slow scan direction S, where necessary according to the image to be printed. At the moment of firing the set of A nozzles, the set of B nozzles is located at a location 40 at a distance of 94.07 μm behind the set of A nozzles. Before firing the set of B nozzles, the head 10 is moved over a distance of 13.44 μm in the fast scan direction F. The set of B nozzles eject a drop on locations 42 on a straight line 43 in the slow scan direction S, where necessary according to the image to be printed.

The above printing scheme is continued in the same way. In the next (third) ABC cycle, the drops of the B nozzles are ejected on locations on straight line 16, where necessary according to the image to be printed, and the drops of the C nozzles are ejected on locations on straight line 24, where necessary according to the image to be printed.

This corresponds to what is given in equations (6): for c=7 and ABC cycling, $$\Delta cycle_{A-B} = \text{int}\left(\frac{7}{3}\right) = 2 \tag{8}$$

$$\Delta cycle_{A-C} = \text{int}\left(\frac{2*7}{3}\right) = 4$$

Thus if the set of A nozzles prints on a straight line during cycle x (e.g. straight line 16 during cycle 1), the set of B nozzles will print on that same straight line during cycle x+2 (cycle 3 in the example given), and the set of C nozzles will print on that same straight line during cycle x+4 (cycle 5 in the example given).

The printhead 10 continues to move on in the fast scan direction F up to the end of the printing medium on which an image is to be printed, according to the content of the image to be printed. Dots are printed on straight lines 16, 24, 30, 38, 43 and so on, in the slow scan direction S, each straight line comprising dots printed by the set of A nozzles, the set of B nozzles and the set of C nozzles, if necessary for the image to be printed. The distance between two straight lines in the slow scan direction is 1/(c.headtype)=1/(7.90) inches=40.32 μm, which shows that an image at 630 dpi is printed.

Figure 3:
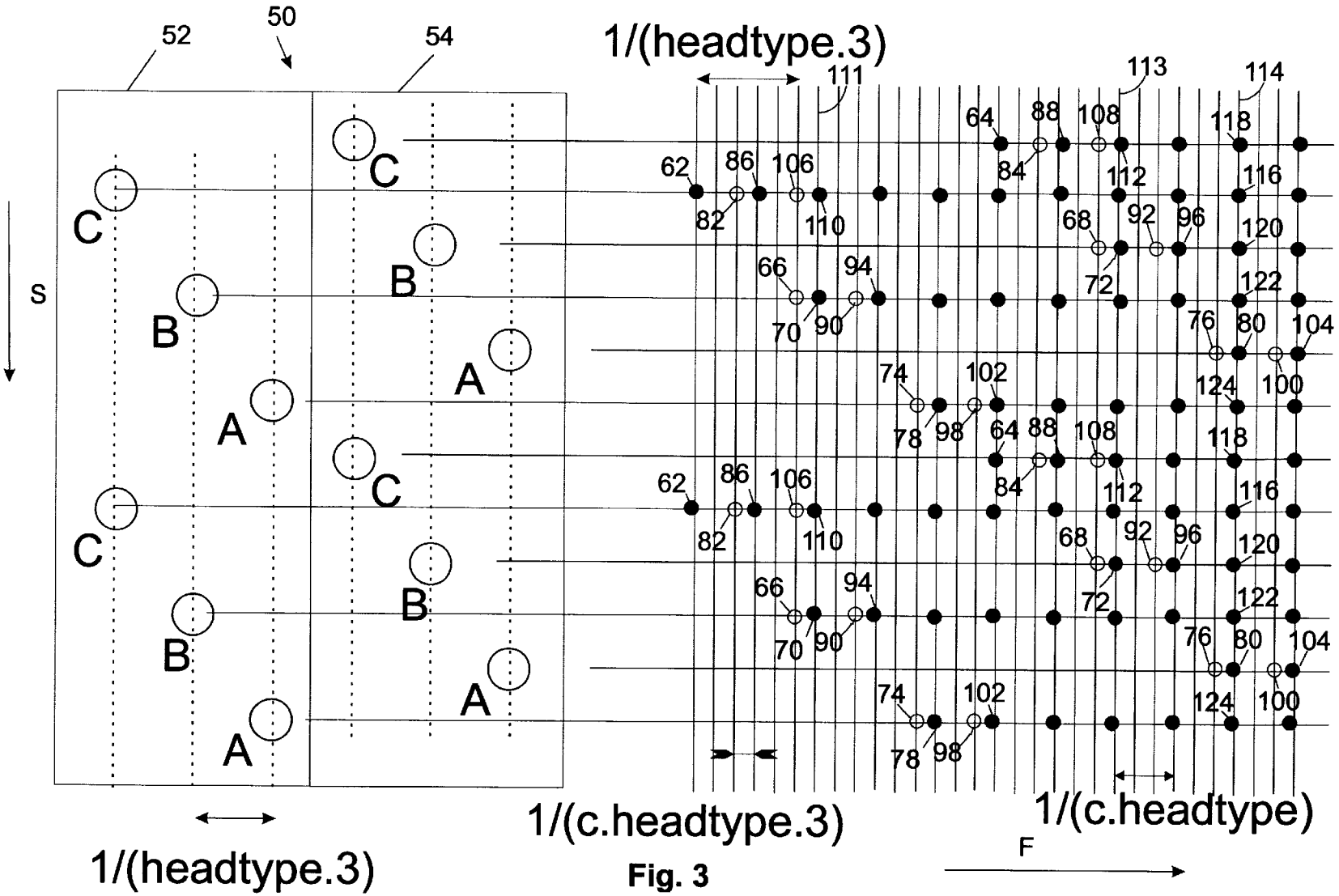
FIG. 3 is a front view of a printhead with two arrays of marking elements, each having a first resolution, the nozzle arrays being placed so that the combined resolution equals twice the first resolution.

In FIG. 3, a nozzle plate 50 of two nozzle arrays 52, 54 is shown, each nozzle array 52, 54 having 225 npi (nozzles per inch), and placed so that the combined resolution is 450 dpi (i.e. whereby each nozzle of the second nozzle array 54 is always located in the middle, in the slow scan direction S, between two nozzles of the first nozzle array 52). The distance between two adjacent nozzles of one nozzle array in the slow scan direction S is 112.89 μm. The nozzle stagger in the fast scan direction F is 94.07 μm (type 90 head).

As an example, the type 90 head is used in 450 dpi mode to obtain an image with a resolution of 900 dpi in at least two passes. A type 90 head used in mode 450 follows a CBA printing cycle, as shown in Table 1.

During a first pass, at first during a first cycle, the sets of C nozzles are fired. Where necessary (according to the image), C nozzles eject a drop on the printing medium, whereby C nozzles of the first nozzle array 52 eject drops on locations 62, and C nozzles of the second nozzle array 54 eject drops on locations 64. At the moment of firing the sets of C nozzles, the set of B nozzles of the first array 52 is located at location 66 at a distance of 1/(headtype.3)=94.07 μm before the set of C nozzles of the first array 52, and the set of B nozzles of the second array 54 is located at locations 68 at a distance of 94.07 μm before the set of C nozzles of the second array 54. Before firing the sets of B nozzles, the head 50 is moved over a distance 1/(c.headtype.3)=18.81 μm in the fast scan direction F. During the first cycle, the set of B nozzles of the first nozzle array 52 ejects a drop on locations 70, where necessary according to the image to be printed, and the set of B nozzles in the second array 54 ejects a drop on locations 72, where necessary according to the image to be printed. At the moment of firing the sets of B nozzles, the set of A nozzles of the first array 52 is located at a location 74 at a distance of 94.07 μm before the set of B nozzles of the first array 52, and the set of A nozzles of the second array 54 is located at a location 76 at a distance of 94.07 μm before the set of B nozzles of the second array 54. Before firing the sets of A nozzles, the head 50 is moved over a distance of 18.81 μm in the fast scan direction F. The set of A nozzles of the first array 52 ejects a drop on locations 78, and the set of A nozzles of the second array 54 ejects a drop on location 80, both where necessary according to the image to be printed.

When the sets of A nozzles are firing, the set of C nozzles of the first array 52 is located at locations 82, and the set of C nozzles of the second array 54 is located at locations 84. Before firing the sets of C nozzles during the second cycle, the head 50 is moved over a distance of 18.81 μm in the fast scan direction F. The set of C nozzles of the first array 52 ejects a drop on locations 86, and the set of C nozzles of the second array 54 ejects a drop on locations 88, both where necessary according to the image to be printed.

At the moment of firing the sets of C nozzles, the set of B nozzles of the first array 52 is located at location 90 at a distance of 94.07 μm before the set of C nozzles of the first array 52, and the set of B nozzles of the second array 54 is located at locations 92 at a distance of 94.07 μm before the set of C nozzles of the second array 54. Before firing the sets of B nozzles during the second cycle, the head 50 is moved over a distance of 18.81 μm in the fast scan direction F. The set of B nozzles of the first nozzle array 52 ejects a drop on locations 94, where necessary according to the image to be printed, and the set of B nozzles in the second array 54 ejects a drop on locations 96, where necessary according to the image to be printed. At the moment of firing the sets of B nozzles, the set of A nozzles of the first array 52 is located at a location 98 at a distance of 94.07 μm before the set of B nozzles of the first array 52, and the set of A nozzles of the second array 54 is located at a location 100 at a distance of 94.07 μm before the set of B nozzles of the second array 54. Before firing the sets of A nozzles during the second cycle, the head 50 is moved over a distance of 18.81 μm in the fast scan direction F. During the second printing cycle, the set of A nozzles of the first array 52 ejects a drop on locations 102, where necessary according to the image to be printed, and the set of A nozzles of the second array 54 ejects a drop on location 104, where necessary according to the image to be printed.

When the sets of A nozzles are firing, the set of C nozzles of the first array 52 is located at locations 106, and the set of C nozzles of the second array 54 is located at locations 108. Before firing the sets of C nozzles during a third printing cycle, the head 50 is moved over a distance of 18.81 μm in the fast scan direction F. The set of C nozzles of the first array 52 ejects a drop on locations 110, where necessary according to the image to be printed, and the set of C nozzles of the second array 54 ejects a drop on locations 112, where necessary according to the image to be printed. Drops printed by the set of C nozzles of the first array 52 on locations 110 during the third printing cycle are printed on a straight line 111, on which line 111 previously (during the first printing cycle) drops 70 have been printed by the set of B nozzles of the first array 52. In the same manner, drops printed by the set of C nozzles of the second array 54 on locations 112 during the third printing cycle are printed on a straight line 113, on which line 113 previously (during the first printing cycle) drops 72 have been printed by the set of B nozzles of the second array 54.

This printing scheme continues. The continuation of the printing scheme is shown in FIG. 3 without further numbering of the dots. As can be seen, as from straight line 114 in the slow scan direction, drops are printed on locations 116 by the set of C nozzles of the first array 52, while on that same straight line 114 drops 118, 120, 122, 80, 124 have already been printed previously by the set of C nozzles of the second array 54, the set of B nozzles of the second array 54, the set of B nozzles of the first array 52, the set of A nozzles of the second array 54, and the set of A nozzles of the first array 52, respectively.

Before starting a second pass, the printhead 50 is moved in the slow scan direction S so as to make droplets fall in between already printed droplets in the slow scan direction S. For the example under consideration, if the resolution is to be obtained in two passes, the printhead 50 is moved in the slow scan direction S over a paper feed distance of 28.22 $\mu$m or an odd multiple thereof. During the second and further printing passes, a CBA cycle is then applied as explained for the first printing pass.

According to the above it is clear that it is only possible to have dots from three phases printed during one cycle on one slow scan line using a normal print order for the data if the print head type and mode are equal. Otherwise the print data must be reorganised or "shuffled" so that the correct data is presented to the relevant nozzle at the right time.

The most convenient solution consists in shifting the pixel lines along the fast scan direction (if different nozzle arrays are combined resulting in pixel lines belonging to one phase one also speaks of image bands) related to the different phases over a number of cycles as given by formula 6 or 7. In case a 3 phase system with phases ABC, the shift between pixel line A and B and between B and C is equal to a number equal to the Δcycle as given by formula 6 (formula 7 in case a CBA cycle is involved). It is necessary to reorganise the sequence of input data so that the final image is correctly printed. When data for pixels on a certain slow scan line is printed by the A phase, the data for the same slow scan line but for the B-phase nozzles will be presented to them later. Another Δcycle later the C-phase nozzles will receive the data related to that slow scan line. When one cycle is considered, the B-phase prints during that cycle a dot that is Δcycle dot positions behind the A phase, while the C-phase is printing 2 Δcycle dot positions behind the A phase. For example, 2 or 4 dot positions as defined in equation 8. The data transformation needs to be done for each new fast scan because it is possible that when using mutually interstitial printing, nozzles belonging to different phases print a certain pixel line in the fast direction.

This printing technique requires more pixel positions than the number of pixel positions in a fast scan pixel line to finish a fast scan than would be required if the nozzles were not staggered but on a straight line.

It is now explained in more detail how paper feeds in between successive printing passes are calculated and how wet-on-wet printing or bleeding is avoided by enforcing boundary conditions on the colour sequence.

Figure 4:
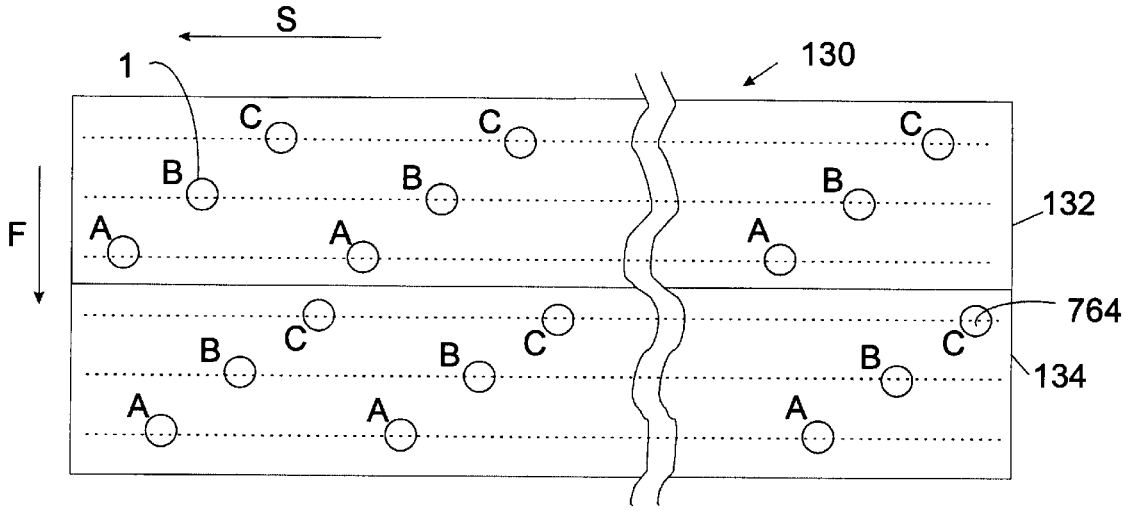
FIG. 4 schematically shows a printhead consisting of two staggered nozzle arrays.

The following is a general calculation scheme to obtain values for a paper feed $L_1$ and a paper feed $L_2$, expressed in pixels (on the final image resolution). It will be explained, based on a printhead 130 as shown in FIG. 4, having n=764 nozzles. The printhead itself consists of 2 nozzle arrays 132, 134, each having 382 nozzles with each a nozzle pitch of 180 npi. By shifting both nozzle arrays 132, 134 over half a pitch, the complete 764 nozzle head 130 has a nozzle pitch of 360 npi. Each of the two nozzle arrays 132, 134 consists of 3 phases (A, B and C). The calculation given does not consider the staggering of the nozzles in the different phases nor the phases itself.

First an imaginary paper feed $L_{base}$ is calculated by dividing the length of the head 130 (expressed in pixels on the final resolution) by the total number of required passes (equal to the number of sub-images to be printed). The length of the head 130 is $$n\left(\frac{NP}{DP}\right) = 764 * \frac{720}{360} = 1528 \text{ pixels} \tag{9}$$

with nozzle pitch NP=(1/360) inch and pixel pitch DP=(1/720) inch. In fact, when the first pixel corresponding with nozzle 1 is also labeled pixel number 1, the last pixel corresponding with nozzle 764 is pixel 1527. The image needed is $1527 \times w_p \times 720$ (with 720 dpi resolution and $w_p$ the printing width). The number of passes needed to print all pixels, is given by P(I/hs), where P is the number of mutually interstitial printing passes, I is the required number of interlacing steps (normally given by dpi/npi or NP/DP). Interlacing is used to increase the resolution of a printing device. That is, although the spacing between nozzles on the printing head along the slow scan direction S is a certain distance X, the distance between printed dots in the slow scan direction S is less than this distance. The relative movement between the printing medium (not shown) and the printing head 130 is indexed by a distance given by the distance X divided by an integer. If the values of the example above are taken, the number of interlacing steps equals I=dpi/npi=720/360=2 and the number of mutually interstitial printing steps P=8. The parameter hs, the number of nozzle rows printing the same colour, is used when different nozzle arrays of a same colour are considered: in the current example n=764 nozzles is taken at 360 npi and therefore hs=1. In case the two nozzle arrays of n=382 nozzles (each at 180 npi) would have been taken separately, hs=2 must be taken, but also the number of interlacing steps I doubles (because 720/180=4) and the final result for $L_{base}$ would be the same.

The result for $L_{base}$ in the given example is the integer value $$n\frac{\left(\frac{NP}{DP}\right)}{P\left(\frac{I}{hs}\right)},$$

or thus:

$$L_{base} = \text{int}\left[n\frac{\left(\frac{NP}{DP}\right)}{P\left(\frac{I}{hs}\right)}\right] = \text{int}(95.5), \tag{10}$$

being 95 pixels. In this example, there is one line of non printed pixels in the fast scan direction F in between two consecutive nozzles in the slow scan direction S (as the number of interlacing steps equals 2).

A parameter I' is then introduced, defined as:

$$I' = \frac{I}{hs}, \tag{11}$$

I being the number of interlacing steps needed and hs being the number of nozzle rows printing the same colour.

A paper feed is derived from $L_{base}$ that is equal to a multiple of I' by doing $L_{base}-L_{base}$mod I', resulting in 94. Because I'=2, and 94 is thus a multiple of I', paper feeds based on this value would always print in the same 360 dpi image, never addressing the pixels between the nozzles.

To avoid the above, the value of 94 is incremented by $l_1$ or $l_2$ (respectively for a first paper feed $L_1$ and a second paper feed $L_2$) An odd value for one of the paper feeds guarantees that there will also be printed on pixel lines not addressed before (the other paper feed can be even).

$$\begin{cases} L_1 = \max(L_{base} - L_{base}\ mod I' + l_1 - jI', I')\ j = 0, 1, \ldots \\ L_2 = \max(L_{base} - L_{base}\ mod I' + l_2 + (1+i)I', I')\ i = 0, 1, \ldots \end{cases} \tag{12}$$

The above formulae for the first paper feed $L_1$ and the second paper feed $L_2$ can generate a whole set of values depending on the chosen $l_1$, $l_2$ and j and i. By applying a number of boundary conditions on $l_1$, $l_2$ for I'>2, this set can be limited.

$$|l_1|=1,3,5,7, \ldots <k$$

$$|l_2|=1,2,3,4, \ldots <k' \tag{13}$$

$$\text{if } I'>2 \text{ then } l_1+l_2 \neq kI'\ k \text{ integer} \tag{14}$$

Further, $L_1$ and $L_2$ must meet a set of two equations:

- a linear combination of $L_1$ and $L_2$ should equal the total length of the head expressed in pixels
- the factors a and b, used to combine $L_1$ and $L_2$, should equal to the total number of passes P*I' (=16 in this particular case).

or written in symbols:

$$\begin{cases} aL_1 + bL_2 = \left(\frac{NP}{DP}\right)n \\ a + b = P * I' \end{cases} \tag{15}$$

A different way for writing the above more explicitly as a function of $l_1$, $l_2$, i and j is:

$$L_1=(L_{base}-L_{base} \bmod I')+l_1-jI'$$

$$L_2=L_1-l_1+l_2+(1+i+j)I'$$

$$a=P*I'-b \tag{16}$$

$$b = \frac{\left(n\left(\frac{NP}{DP}\right) - L_1 * P * I'\right)}{l_2 - l_1 + (1+i+j)I'} \tag{16}$$

For the above example, possible values for $L_1$ and $L_2$ could be: for i=0, j=, 0, $l_1$=1, $l_2$=1:

$$\begin{cases} L_1 = 95 \\ L_2 = 97 \end{cases} \tag{17}$$

The above calculation scheme of equation (16) can find all $L_1$, $L_2$ and associated a and b based on $l_1$, $l_2$, i and j. Although this is the most general method, it is often advantageous to restrict to a subset of the above. The above method allows any filling order.

When printing different colours, it is desired that the different colours e.g. CMYK are printed in a same order on all pixels. To guarantee this, the image is being filled up in a regular way. This can be guaranteed by shifting nozzle arrays of a different colour over a distance of at least 3/P in the slow scan direction, P being the number of mutually interstitial printing passes. The value of 3 is derived as follows: a sub-image table counts N lines. When in a sub-image table three pixel rows are filled row by row, there can be started with the next colour on the second row (also starting on the first row could result in bleeding towards row N of the sub image table), while the first colour is printed on the fourth row. As said, the distance two consecutive heads need to be shifted is at least 3/P. The exact amount the printheads need to be shifted is calculated as follows: if only $l_1$ and $L_2$ are used it is tried to make a sequence as short as possible of formfeeds $L_1$ and $L_2$ that is repeated during the printing process: e.g. if there is a P*I'=4×4=16 and $L_1L_1L_1L_2$, $L_1L_1L_1L_2$, $L_1L_1L_1L_2$, $L_1L_1L_1L_2$, . . . each period in the sequence has a length I'=4 which agrees with a row of the sub-image table. After 3 rows it is allowed to start the next colour. In this specific case the sum of the 3 periods is exactly 3/P of the headlength. To make the distance between the heads as short as possible a period equal to I' or I' being a multiple of this periodlength (ixperiod=I') is required. The minimum headshift can be written as follows:

$$\Delta x=3(I'-1)L_1+3L_2$$

When all $L_i$ are different there are still needed 3×I' passes before the next colour is allowed to start. Because in this case all $L_i$ are different, the following condition must be fulfilled:

$$\Delta x = \max\left(\sum_{i=j}^{(j+3I')\bmod PI'} L_i\right) \text{ with } 1 < j < PI'$$

It is of course possible in the above to add more types of paper feeds $L_3$, $L_4$, etc., in which case the above formulae can be amended correspondingly. It is possible to broaden the above theory for $L_1$, and $L_2$ towards as much $L_i$ as there are passes P*I'. In that case, $L_i$ should meet the following condition:

$$\sum_{i=1}^{SI'} L_i = \left(\frac{NP}{DP}\right)n$$

Now one concept for applying mutually interstitial printing with the head configurations described above is explained in more detail: shifting of image bands over Δcycle pixels.

Figure 5:
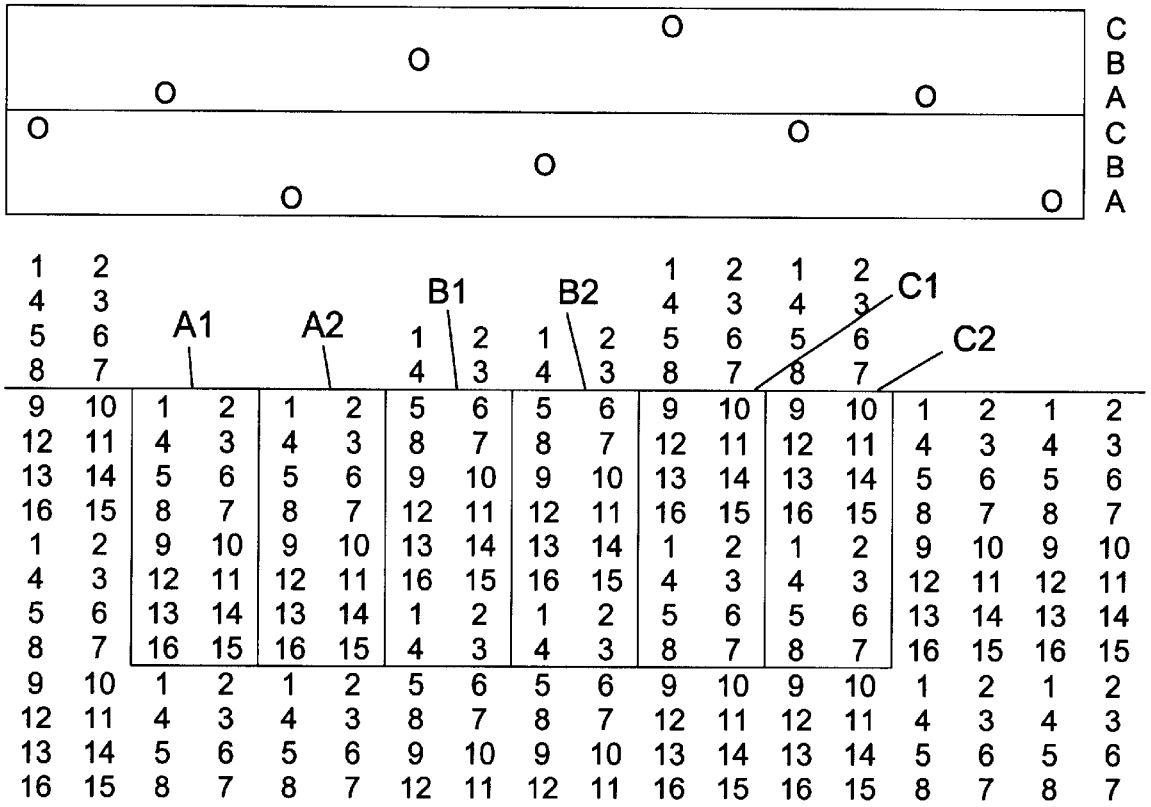
FIG. 5 is a printing scheme for 12.5% mutually interstitial printing according to an embodiment of the present invention.

One of the possibilities is to allow for shifting of image bands over Δcycles using "redundant cycles" (mutually interstitial printing) to print all pixels on a same line in the slow scan direction without omitting nozzles or reducing the number of active nozzles of the printhead. The print speed will be lower, related to the amount of mutually interstitial printing but quality is higher. In FIG. 5 for a number of mutually interstitial printing passes P=8, a type 90 head is used in 360 dpi mode resulting in Δcycle=l. This means that a fire pulse is available at half (360 dpi) of the pixels (720 dpi) in the fast scan direction. Doing this allows the classical way of calculating L, and e.g. $L_1$,=96 and $L_2$=95 is obtained.

When the set of A nozzles receive a fire pulse during pass 1 above a pixel indicated with a "1" in FIG. 5 the B and C nozzles are not used during the same ABC cycle. At the next fire pulse or cycle, the A nozzles pass above pixels indicated with 5, but are not fired. Instead the B nozzles are fired during this pass 1 above the location indicated with 5. So the A and C nozzles are not fired during this second ABC cycle. Finally, at the third fire pulse or cycle, the A-nozzles and the B-nozzles pass above pixels 9 without being fired, while the C-nozzles are fired at pixels indicated with a 9. The next fire pulse is a fully redundant pulse: no nozzles are fired at position 13.

Before pass 2 is carried out, a paper feed of $L_1$=96 pixels is carried out in the slow scan direction. When the set of A nozzles receive a fire pulse during pass 2 above a pixel indicated with a 2 in FIG. 5, the B and C nozzles are not used during the same ABC cycle. At the next fire pulse or cycle, the A nozzles pass above pixels indicated with 6, but are not fired. Instead the B nozzles are fired during this pass 2 above the location indicated with 6. So the A and C nozzles are not fired during this second ABC cycle. Finally, at the third fire pulse or cycle, the A-nozzles and the B-nozzles pass above pixels 10 without being fired, while the C-nozzles are fired at pixels indicated with a 10. The next fire pulse is a fully redundant pulse: no nozzles are fired at position 14.

In the next pass, a paper feed of $L_2$=95 pixels is used. From then on, the paper feed is alternated between 96 and 95 pixels. Printing goes on, and 16 passes are needed to print the complete image.

From the above, the following rule can be derived: during pass X, the A-nozzles print at all pixel positions in FIG. 5 labelled with the pass number X, the B-nozzles print at all pixel positions having the number X+4 and the C nozzles print at pixel positions having the number X+8.

For a number of mutually interstitial printing passes of P=2, there is no redundancy (fast mutually interstitial printing), but it is possible to fill row-by-row by shifting the image bands under the B and C nozzles over respectively 2 and 4 pixels. This is basically also what has been done for P=4 and P=8.

SECOND EMBODIMENT: ϕ MARKING ELEMENTS IN A GROUP

The above formulae can be formulated more generally for a system using ϕ phases as shown below:

Forward: c=ϕi+1

$$\begin{aligned}
&\textit{Forward}:\ c = \varphi i + 1 \qquad (18)\\
&\Delta cycle_{A-B} = \mathrm{int}\left(\frac{c}{\varphi}\right) \text{ or } distance_{A-B} = (\Delta cycle_{A-B} \times \text{pitch}) \text{ inches}\\
&\Delta cycle_{A-C} = \mathrm{int}\left(\frac{2c}{\varphi}\right) \text{ or } distance_{A-C} = (\Delta cycle_{A-C} \times \text{pitch}) \text{ inches}\\
&\Delta cycle_{A-D} = \mathrm{int}\left(\frac{3c}{\varphi}\right) \text{ or } distance_{A-D} = (\Delta cycle_{A-D} \times \text{pitch}) \text{ inches}\\
&\ldots\\
&\Delta cycle_{A-\varphi} = \mathrm{int}\left(\frac{(\varphi-1)c}{\varphi}\right) \text{ or } distance_{A-\varphi} = (\Delta cycle_{A-\varphi} \times \text{pitch}) \text{ inches}
\end{aligned}$$

$$\begin{aligned}
&\textit{Backward}:\ c = \varphi i - 1 \qquad (19)\\
&\Delta cycle_{B-A} = \mathrm{int}\left(\frac{c}{\varphi}\right) + 1 \text{ or } distance_{B-A} = (\Delta cycle_{B-A} \times \text{pitch}) \text{ inches}\\
&\Delta cycle_{C-A} = \mathrm{int}\left(\frac{2c}{\varphi}\right) + 1 \text{ or } distance_{C-A} = (\Delta cycle_{C-A} \times \text{pitch}) \text{ inches}\\
&\Delta cycle_{D-A} = \mathrm{int}\left(\frac{3c}{\varphi}\right) + 1 \text{ or } distance_{D-A} = (\Delta cycle_{D-A} \times \text{pitch}) \text{ inches}\\
&\ldots\\
&\Delta cycle_{\varphi-A} = \mathrm{int}\left(\frac{(\varphi-1)c}{\varphi}\right) + 1 \text{ or } distance_{\varphi-A} = (\Delta cycle_{\varphi-A} \times \text{pitch}) \text{ inches}
\end{aligned}$$

Figure 6:
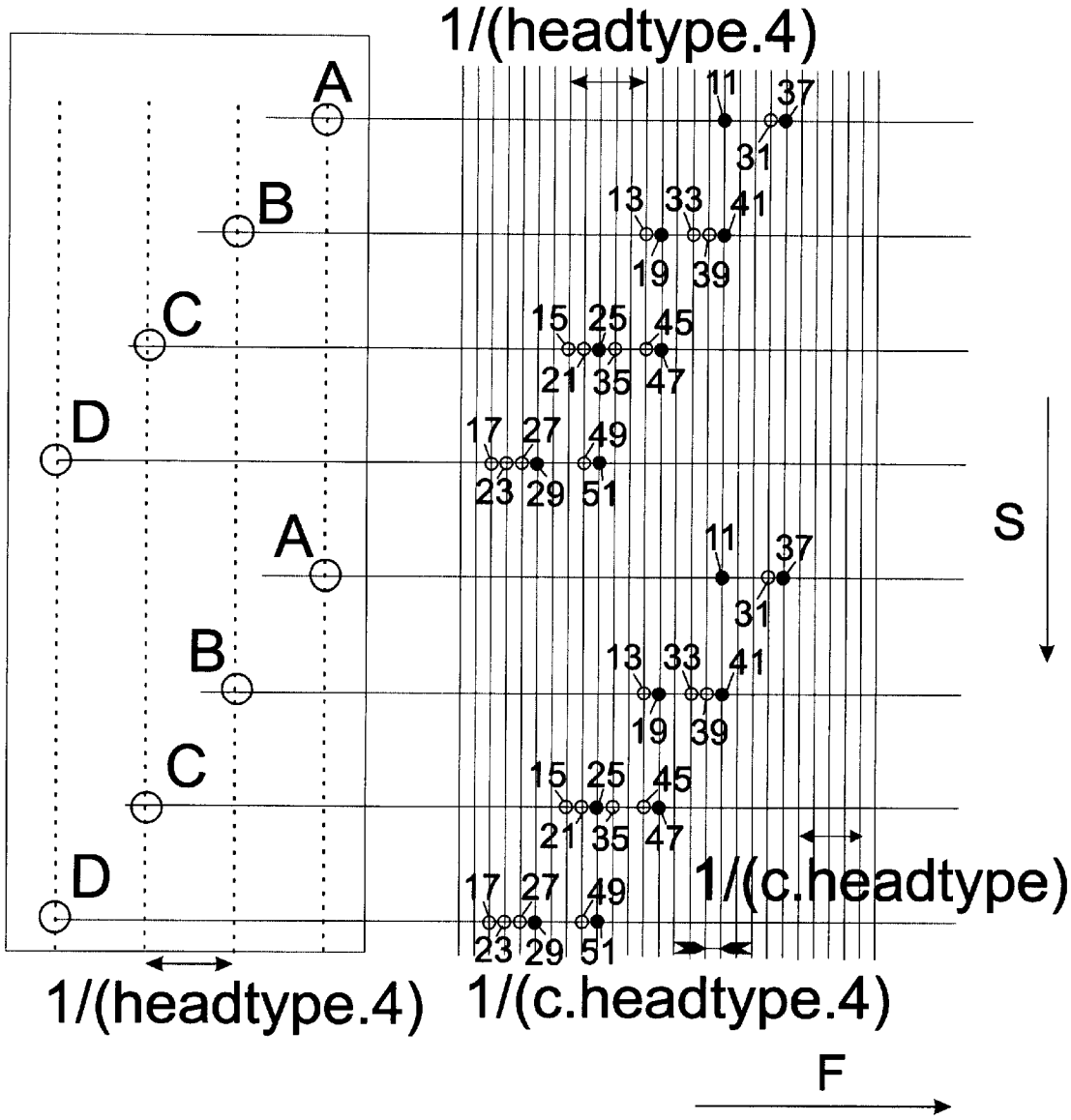
FIG. 6 schematically illustrates an ABCD printing scheme in accordance with an embodiment of the present invention for a printing head with four marking elements in one group.

An example of a printing scheme for a system with four marking elements in a group (number of phases ϕ is four) is given in FIG. 6, and is explained hereinafter. As an example, a type 90 head is used in mode 450 dpi, i.e. c=5, or thus, as can be seen from equation (18) the forward scheme or ABCD cycling is to be used.

As shown in Table 1, the normal speed or reference speed for a 90 type head is 3.50 m/s. According to equation (1), the speed in the 450 dpi mode is 3.50/5=0.70 m/s.

For ABCD cycling, first the set of A nozzles is driven. Where necessary, according to the image, A nozzles eject a drop on locations 11. At the moment of firing the set of A nozzles, the set of B nozzles is located at a location 13 at a distance of 1/(headtype.4)=1/90.4=1/360 inches=70.56 μm behind the set of A nozzles, the set of C nozzles is located at location 15 at a distance of 141.11 μm behind the set of A nozzles, and the set of D nozzles is located at location 17 at a distance of 211.67 μm behind the set of A nozzles. Before firing the set of B nozzles, the head is moved over a distance 1/(c.headtype.4)=1/1800 inches=14.11 μm in the fast scan direction F. The set of B nozzles eject a drop on locations 19, where necessary according to the image to be printed. At the moment of firing the set of B nozzles, the set of C nozzles is located at a location 21 at a distance of 70.56 μm behind the set of B nozzles, and the set of D nozzles is located at a location 23 at a distance of 141.11 μm behind the set of B nozzles. Before firing the set of C nozzles, the head 10 is moved over a distance of 14.11 μm in the fast scan direction F. The set of C nozzles eject a drop on locations 25 where necessary according to the image to be printed. At the moment of firing the set of C nozzles, the set of D nozzles is located at a location 27 at a is distance of 70.56 μm behind the set of C nozzles. Before firing the set of D nozzles, the head 10 is moved over a distance of 14.11 μm in the fast scan direction F. The set of D nozzles eject a drop on location 29, where necessary according to the image to be printed.

At the moment of firing the set of D nozzles, the set of A nozzles is located at a location 31 at a distance of 211.67 μm in front of the set of D nozzles, the set of B nozzles is located at a location 33 at a distance of 141.11 μm in front of the set of D nozzles, and the set of C nozzles is located at locations 35 at a distance of 70.56 μm in front of the set of D nozzles. Before firing the set of A nozzles, the head 10 is moved over a distance of 14.11 μm in the fast scan direction F. The set of A nozzles eject a drop on locations 37, where necessary according to the image to be printed. At the moment of firing the set of A nozzles, the set of B nozzles is located at a location 39 at a distance of 70.56 μm behind the set of A nozzles. Before firing the set of B nozzles, the head 10 is moved over a distance of 14.11 μm in the fast scan direction F. The set of B nozzles eject a drop on locations 41, where necessary according to the image to be printed. At the moment of firing the set of B nozzles, the set of C nozzles is located at locations 45 at a distance of 70.56 μm behind the set of B nozzles. Before firing the set of C nozzles, the head 10 is moved over a distance of 14.11 μm in the fast scan direction F. The set of C nozzles eject a drop on locations 47 where necessary according to the image to be printed. At the moment of firing the set of C nozzles, the set of D nozzles is located at locations 49 at a distance of 70.56 μm behind the set of C nozzles. Before firing the set of D nozzles, the head 10 is moved over a distance of 14.11 μm in the fast scan direction F. The set of D nozzles eject a drop on locations 51, where necessary according to the image to be printed.

The above printing scheme is continued in the same way. In the next ABCD cycles, the drops are all put on parallel straight lines in the slow scan direction, as can be seen from FIG. 6, each straight line comprising dots printed with each of the sets of nozzles A, B, C, D. The distance in the fast scan direction between two straight lines in the slow scan direction is 1/(c.headtype)=1/(5.90) inches=56.44 μm, which shows that a 450 dpi image is being printed.

Figure 7:
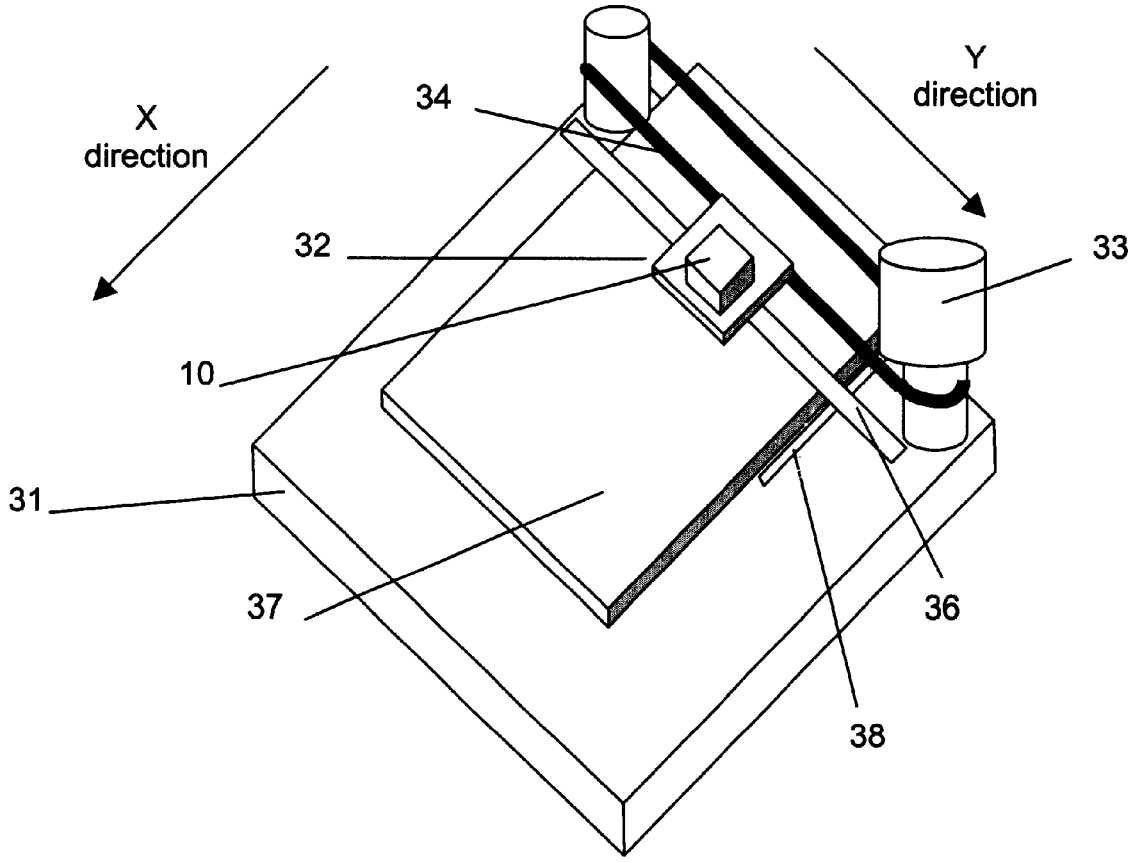
FIG. 7 is a highly schematic representation of an inkjet printer for use with the present invention.

FIG. 7 is a highly schematic general perspective view of an inkjet printer 20 which can be used with the present invention. The printer 20 includes a base 31, a carriage assembly 32, a step motor 33, a drive belt 34 driven by the step motor 33, and a guide rail assembly 36 for the carriage assembly 32. Mounted on the carriage assembly 32 is a print head 10 that has a plurality of nozzles. The print head 10 may also include one or more ink cartridges or any suitable ink supply system. A sheet of paper 37 is fed in the slow scan direction over a support 38 by a feed mechanism (not shown). The carriage assembly 32 is moved along the guide rail assembly 36 by the action of the drive belt 34 driven by the step motor 33 in the fast scanning direction.

Figure 8:
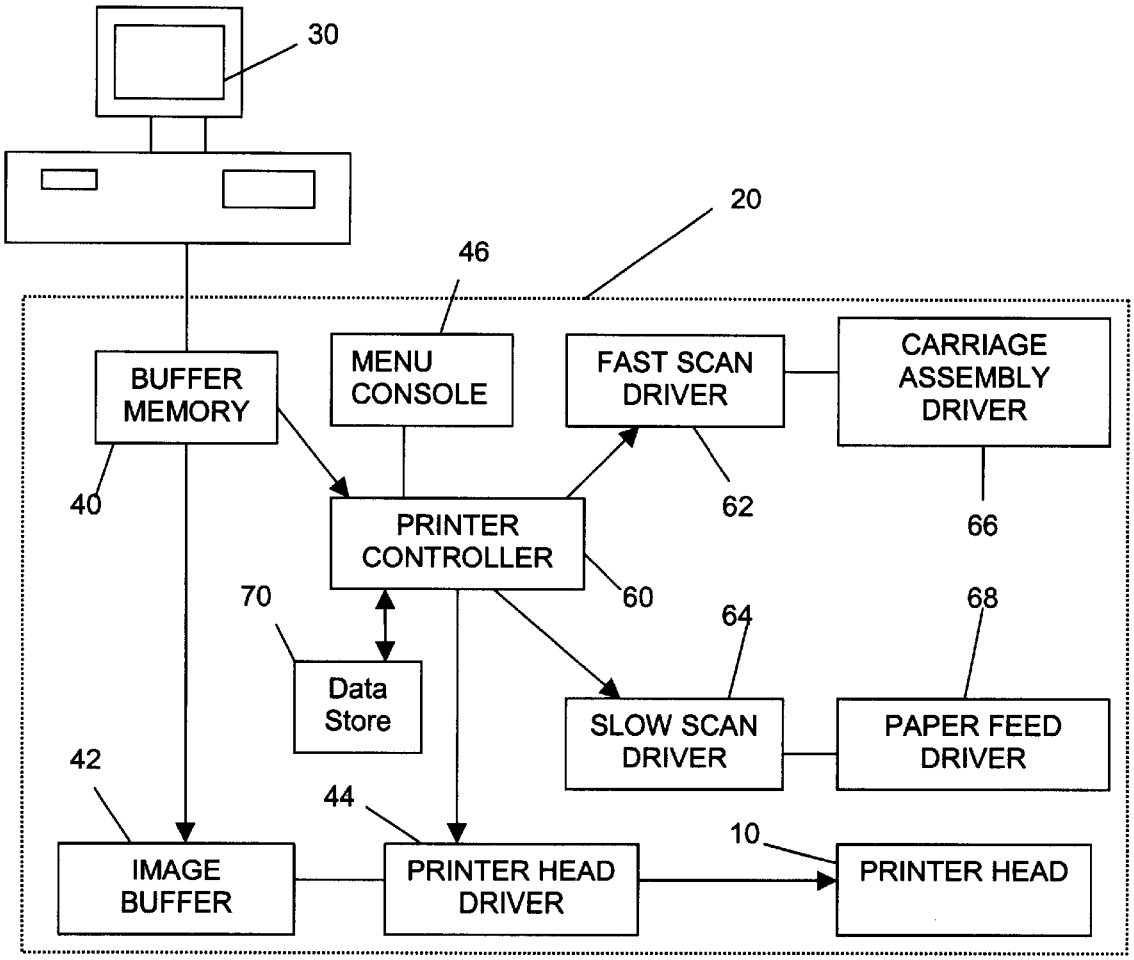
FIG. 8 is a schematic representation of a printer controller in accordance with an embodiment of the present invention.

FIG. 8 is a block diagram of the electronic control system of a printer 20, which is one example of a control system for use with a print head 10 in accordance with the present invention. The printer 20 includes a buffer memory 40 for receiving a print file in the form of signals from a host computer 30, an image buffer 42 for storing printing data, and a printer controller 60 that controls the overall operation of the printer 10. Connected to the printer controller 60 are a fast scan driver 62 for a carriage assembly drive motor 66, a slow scan driver 64 for a paper feed drive motor 68, and a head driver 44 for the print head 10. Optionally, there is a data store 70 for storing parameters for controlling the interlaced and mutual interstitial printing operation in accordance with the present invention. Host computer 30 may be any suitable programmable computing device such as personal computer with a Pentium III microprocessor supplied by Intel Corp. U.S. A, for instance, with memory and a graphical interface such as Windows 98 as supplied by Microsoft Corp. USA. The printer controller 60 may include a computing device, e.g. microprocessor, for instance it may be a microcontroller. In particular, it may include a programmable printer controller, for instance a programmable digital logic element such as a Programmable Array Logic (PAL), a Programmable Logic Array, a Programmable Gate Array, especially a Field Programmable Gate Array (FPGA). The use of an FPGA allows subsequent programming of the printer device, e.g. by downloading the required settings of the FPGA.

The user of printer 20 can optionally set values into the data store 70 so as to modify the operation of the printer head 10. The user can for instance set values into the data store 70 by means of a menu console 46 on the printer 20. Alternatively, these parameters may be set into the data store 70 from host computer 30, e.g. by manual entry via a keyboard. For example, based on data specified and entered by the user, a printer driver (not shown) of the host computer 30 determines the various parameters that define the printing operations and transfers these to the printer controller 60 for writing into the data store 70, e.g. the resolution. One aspect of the present invention is that the printer controller 60 controls the operation of printer head 10 in accordance with settable parameters stored in data store 70. Based on these parameters, the printer controller reads the required information contained in the printing data stored in the buffer memory 40 and sends control signals to the drivers 62, 64 and 44. In particular controller 60 is adapted for a dot matrix printer for printing an image on a printing medium, the control unit comprising, software or hardware means for controlling printing of the image as at least one set of monochromatic mutually interstitially printed images, and software or hardware means for setting the resolution. The controller may be used for independently setting the resolution. The controller is also adapted to control the operation of the printing head 10 so that each mutually interstitial printing step and/or each interlacing step is a pass of the printing head 10 at the appropriate resolution. As explained above the printing head has an array of marker elements under the control of the controller. For instance the controller may be adapted so that for a specific resolution the speed of the head in the fast scan direction and the sequence of firing of the staggered nozzles is controlled.

For instance, the printing data is broken down into the individual colour components to obtain image data in the form of a bit map for each colour component which is stored in the receive buffer memory 30. In accordance with control signals from the printer controller 60, the head driver 44 reads out the colour component image data from the image buffer memory 52 in accordance with a specified resolution to drive the speed and the array(s) of nozzles on the print head 10 to achieve the required resolution.

As indicated above the controller 60 may be programmable, e.g. it may include a microprocessor or an FPGA. In accordance with embodiments of the present invention a printer in accordance with the present invention may be programmed to provide different resolutions. For example, the basic model of the printer may provide selection of one resolution only. An upgrade in the form of a program to download into the microprocessor or FPGA of the controller 60 may provide additional selection functionality, e.g. a plurality of resolutions. Accordingly, the present invention includes a computer program product which provides the functionality of any of the methods according to the present invention when executed on a computing device. Further, the present invention includes a data carrier such as a CD-ROM or a diskette which stores the computer product in a machine readable form and which executes at least one of the methods of the invention when executed on a computing device. Nowadays, such software is often offered on the Internet or a company Intranet for download, hence the present invention includes transmitting the printing computer product according to the present invention over a local or wide area network. The computing device may include one of a microprocessor and an FPGA.

The data store 70 may comprise any suitable device for storing digital data as known to the skilled person, e.g. a register or set of registers, a memory device such as RAM, EPROM or solid state memory.

While the invention has been shown and described with reference to a preferred embodiment, it will be understood by those skilled in the art that various changes or modifications in form and detail may be made without departing from the scope and spirit of this invention. For instance, the preparation for the printing file to carry out the above mentioned printed embodiments may be prepared by is the host computer 30 and the printer 20 simply prints in accordance with this file as a slave device of the host computer 30. Hence, the present invention includes that the printing schemes of the present invention are implemented in software on a host computer and printed on a printer which carries out the instructions from the host computer without amendment. Accordingly, the present invention includes a computer program product which provides the functionality of any of the methods according to the present invention when executed on a computing device which is associated with a printing head, that is the printing head and the programmable computing device may be included with the printer or the programmable device may be a computer or computer system, e.g. a Local Area Network connected to a printer. The printer may be a network printer. Further, the present invention includes a data carrier such as a CD-ROM or a diskette which stores the computer product in a machine readable form and which can execute at least one of the methods of the invention when the program stored on the data carrier is executed on a computing device. The computing device may include a personal computer or a work station. Nowadays, such software is often offered on the Internet or a company Intranet for download, hence the present invention includes transmitting the printing computer product according to the present invention over a local or wide area network.

What is claimed is:

1. A method of driving a print head (10) having a longitudinal axis in a first direction (S) and having an array of marking elements (A, B, C; A, B, C, D) comprising at least one group (G) of marking elements (A, B, C; A, B, C, D), marking elements (A, B, C; A, B, C, D) of one group (G) being staggered with respect to each other over a stagger distance (D1) in a second direction (F) perpendicular to the first direction (S), the print head (10) being intended to be driven with a reference velocity (Vref) equal to the stagger distance (D1) multiplied by a reference firing frequency (Fref), each marking element of a group being firable at each reference firing frequency pulse, the marking elements (A, B, C; A, B, C, D) of the print head (10) being intended to be fired according to a reference firing order to print an image at a first resolution, wherein the print head (10) is operated at an operating velocity which is different from the reference velocity to print the same image at a different resolution.

2. A method according to claim 1, there being n marking elements (A, B, C; A, B, C, D) in one group (G), wherein the operating velocity is equal to $$\frac{\text{reference velocity}}{nX+1},$$

X being an integer larger than or equal to 0, the firing order of the marking elements (A, B, C; A, B, C, D) to produce the second resolution being the same as the reference firing order (ABC; ABCD).

3. A method according to claim 1, there being n marking elements (A, B, C; A, B, C, D) in one group (G), wherein the operating velocity is equal to, X being an integer larger than 0, the firing order of the marking elements (A, B, C; A, B, C, D) for printing with the second resolution being the same as the inverse of the reference firing order (CBA; DCBA).

4. A method according to claim 1, wherein the marking elements (A, B, C; A, B, C, D) of one group (G) are staggered with respect to each other over a stagger distance (D1) in a second direction (F) perpendicular to the first direction (S) to form a plurality of rows of marking elements, and the method includes delaying printing data representing the image supplied to the marking elements of one row with respect to the printing data supplied to another row.

5. The method of claim 1 for carrying out fast mutually interstitial printing.

6. A computer program product for executing the method as claimed in claim 1 when executed on a computing device associated with a printing head.

7. A machine readable data storage device storing the computer program product of claim 6.

8. A method of transmitting the computer product of claim 6 over a local or wide area telecommunications network.

9. A printing device with a print head (10) having a longitudinal axis in a first direction (S) and having an array of marking elements (A, B, C; A, B, C, D) comprising at least one group (G) of marking elements (A, B, C; A, B, C, D), marking elements (A, B, C; A, B, C, D) of one group (G) being staggered with respect to each other over a stagger distance (D1) in a second direction (F) perpendicular to the first direction (S), the print head (10) being intended to be driven with a reference velocity (Vref) equal to the stagger distance (D1) multiplied by a reference firing frequency (Fref), each marking element of a group being firable at each reference firing frequency pulse, the marking elements (A, B, C; A, B, C, D) of the print head (10) being intended to be fired according to a reference firing order to print an image at a first resolution, further comprising means for driving the print head (10) at an operating velocity which is different from the reference velocity to print the same image at a second resolution of printing.

10. A control unit for a printer for printing an image on a printing medium using a print head (10) having a longitudinal axis in a first direction (S) and having an array of marking elements (A, B, C; A, B, C, D) comprising at least one group (G) of marking elements (A, B, C; A, B, C, D), marking elements (A, B, C; A, B, C, D) of one group (G) being staggered with respect to each other over a stagger distance (D1) in a second direction (F) perpendicular to the first direction (S), the control unit being adapted to control the driving of the print head (10) with a reference velocity (Vref) equal to the stagger distance (D1) multiplied by a reference firing frequency (Fref), and for controlling the firing of one marking element of a group at each reference firing frequency pulse, and for controlling the firing of the marking elements (A, B, C; A, B, C, D) of the print head is (10) according to a reference firing order to print the image at a first resolution, further comprising means for controlling the driving of the print head (10) at an operating velocity which is different from the reference velocity to print the image at a second resolution of printing.

* * * * *